US005296337A

United States Patent [19]

Vargas et al.

[11] Patent Number: 5,296,337

[45] Date of Patent: Mar. 22, 1994

[54] PROCESS FOR RETOUCHING PHOTOGRAPHIC IMAGES CONTAINING A DYE HAVING A CLEAVABLE BALLAST

[75] Inventors: J. Ramon Vargas, Webster; John W. Harder, Rochester; Phillip D. Knight, Fairport; Paul A. Burns; Lynda D. Weber, both of Rochester, all of N.Y.

[73] Assignee: Eastman Kodak Company, Rochester, N.Y.

[21] Appl. No.: 872,473

[22] Filed: Apr. 23, 1992

[51] Int. Cl.[5] ..... G03G 8/00; G03G 7/00; G03G 5/92; G03G 5/94

[52] U.S. Cl. ..... 430/359; 430/357; 430/943; 430/958; 430/462; 430/223

[58] Field of Search ..... 430/357, 943, 958, 390, 430/359, 462, 543, 223

[56] References Cited

U.S. PATENT DOCUMENTS

| | | | |
|---|---|---|---|
| 4,990,430 | 2/1991 | Harder et al. | 430/359 |
| 5,019,492 | 5/1991 | Buchanan et al. | 430/543 |
| 5,021,325 | 6/1991 | Burns et al. | 430/387 |
| 5,051,343 | 9/1991 | Lestina et al. | 430/393 |
| 5,210,007 | 5/1993 | Texter et al. | 430/943 |

FOREIGN PATENT DOCUMENTS

| | | | |
|---|---|---|---|
| 3423821 | 1/1986 | Fed. Rep. of Germany | 430/359 |

OTHER PUBLICATIONS

*Professional Photographer*, Nov. 1989, vol. 116, No. 2130, pp. 44–48.

*Professional Photographer*, Dec. 1989, vol. 116, No. 2131, pp. 30–34.

*Primary Examiner*—Charles L. Bowers, Jr.
*Assistant Examiner*—J. Pasterczyk
*Attorney, Agent, or Firm*—Joshua G. Levitt

[57] ABSTRACT

There are described a method for retouching photographic images, compositions adapted for such retouching, and photographic elements containing dye-forming couplers that yield dye images that particularly lend themselves to retouching by this method. The method comprises contacting a photographic element containing a dye image with a defined retouching composition to solubilize and remove selected areas or amounts of dye. The composition comprises an aqueous basic solution of a dinucleophile and a water-soluble organic co-solvent. The preferred photographic element for application of this retouching method comprises a dye image formed from a pyrazoloazole magenta dye forming coupler having a cleavable ballast group joined to the remainder of the molecule by one or two electrophilic cleavage groups. The retouching composition cleaves the ballast from the dye and solubilizes the dye, allowing it to be washed from the element.

6 Claims, No Drawings

PROCESS FOR RETOUCHING PHOTOGRAPHIC IMAGES CONTAINING A DYE HAVING A CLEAVABLE BALLAST

FIELD OF THE INVENTION

This invention relates to methods of retouching dye images formed from silver halide photographic elements, to compositions adapted for such retouching, and to photographic images and elements particularly adapted for use with these methods and compositions. In a particular aspect it relates to such methods, compositions and elements adapted to retouching of magenta dye images formed from pyrazoloazole dye forming couplers.

BACKGROUND OF THE INVENTION

Images are formed in silver halide color photographic materials by the dye that results from reaction between oxidized silver halide developing agent and a dye-forming compound known as a coupler. It is known to retouch such dye images by selective destruction and/or removal of dye. Retouching techniques are described in photographic publications and literature, such as Professional Photographer, November 1989, Vol. 116, No. 2130, pages 44–48, Professional Photographer, December 1989, Vol. 116, No. 2131, pages 30–34, and in Harder et al. U.S. Pat. No. 4,990,430 issued Feb. 5, 1991.

A problem with the known methods of retouching is that they depend on the selective destruction or solubilization of dyes formed from couplers chosen for reasons other than their retouchability. Thus, it is difficult to differentially remove dye density of one color without also affecting dye of another color. This is particularly true of relatively stable dyes, such as those derived from pyrazoloazole couplers. In photographic elements containing magenta dye images formed from pyrazoloazole dye forming couplers, it is difficult to remove the magenta dye without also affecting the images formed from the cyan and yellow dyes.

Accordingly, it would be desirable to provide elements, compositions and methods with which dye images which normally are difficult to retouch are rendered selectively retouchable. Additionally, it would be desirable to provide a technique that is selectively applicable to dyes formed from couplers of all classes, rather than having the bleaching technique dependent on the fundamental structure of the dye.

SUMMARY OF THE INVENTION

We have found that this can be accomplished by use of a cleavable ballast group on the dye-forming coupler, which ballast group remains on the dye formed on coupling of the coupler with oxidized silver halide color developing agent. The ballast group is cleavable by a specialized retouching composition to cause the dye to be solubilized and removed from the photographic element.

Thus, in one aspect, this invention relates to a method of retouching a dye image formed in a photographic element by a dye having the structure:

D—C—Bal I where:

D is the residue of oxidized silver halide color developing agent,

C is the residue of a dye forming coupler,

Bal is a ballast group which immobilizes the dye in the photographic element and which is cleavable from the remainder of the dye by reaction with a dinucleophile to thereby render the dye mobile, the method comprising:

a) applying to the dye image an aqueous solution of a dinucleophile and a water-soluble organic co-solvent to cleave the ballast group and solubilize the dye, and b) removing solubilized dye from the photographic element.

In another aspect, this invention relates to a photographic element comprising a support bearing a dye image comprised of a dye having the structure:

D—P—Bal II where:

D is the residue of oxidized silver halide color developing agent,

P is the residue of a pyrazoloazole dye forming coupler, and

Bal is a ballast group which immobilizes the dye in the photographic element and which is cleavable from the remainder of the dye by reaction with a dinucleophile to thereby render the dye mobile.

In still another aspect, this invention relates to a photographic element comprising a support bearing a silver halide emulsion associated with a pyrazoloazole magenta dye forming coupler having the structure:

P—Bal III where:

P is a pyrazoloazole dye forming coupler moiety, and

Bal is a ballast group a) which immobilizes the coupler and dye formed from the coupler on color development, b) which is not cleavable from the coupler during color photographic processing, but c) which is cleavable from the dye by reaction with a dinucleophile to thereby render the dye mobile.

In yet another aspect, this invention relates to a retouching composition for removal of dye from photographic elements containing a dye image formed by a dye having the structure:

D—C—Bal I where:

D is the residue of oxidized silver halide color developing agent,

C is the residue of a dye forming coupler,

Bal is a ballast group which immobilizes the dye in the photographic element and which is cleavable from the remainder of the dye by reaction with a dinucleophile to thereby render the dye mobile, the composition comprising an aqueous solution of a) a dinucleophile, and b) a water-soluble organic co-solvent.

DETAILED DESCRIPTION OF THE INVENTION

The dye images which are retouched in accordance with this invention can be formed from couplers, some of which are known in the art and others of which are novel to this invention. The coupler comprise a known coupling nucleus containing a ballast group that remains on the coupler during conventional photographic processing but which is cleavable in a specialized retouching composition to thereby solubilize the dye. Some couplers with such ballast groups are described in U.S. Pat. No. 5,051,343 of Lestina et al. issued Sep. 24, 1991 as being useful in photographic elements where it is desired to remove unreacted coupler from the photographic element during processing. There is no suggestion in that patent that it would be desirable to remove a portion of the image dye density. Furthermore, that patent does not describe specifically magenta dye forming couplers, such as pyrazoloazoles. The latter are the preferred class of couplers with which this invention is employed because of the difficulty in retouching dye images formed from such couplers.

Preferred couplers useful in this invention contain a cleavable ballast group comprising one or two electrophilic cleavage groups that are capable of reacting with a dinucleophile. When two such groups are employed, the least electrophilic is closer to the cleavage site and is separated from the more electrophilic group by a bond, an atom, or a group of atoms that permits a nucleophilic displacement reaction to occur with cleavage of the ballast group.

Preferred couplers can be represented by the structures:

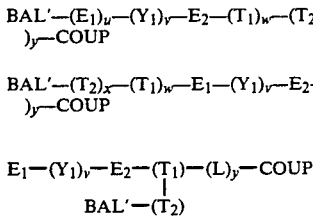

IV

V

VI.

wherein:

u, v, w, x and y are independently 0 or 1;

$E_1$ and $E_2$ are independently electrophilic groups wherein $E_1$ is more electrophilic than $E_2$;

$T_1$ and $T_2$ are individually releasable timing groups;

$Y_1$ is a substituted or unsubstituted atom, preferably a carbon or nitrogen atom, that provides a distance between $E_1$ and $E_2$ that permits a nucleophilic displacement reaction to occur;

L is linking group comprising an optionally substituted alkyl, aryl, alkaryl or heterocyclic group that links the coupler to the remainder of the ballast and can be selected to simplify manufacture, or to influence such properties as rate of cleavage, rate of coupling, dye hue and dye stability;

BAL' provides sufficient bulk with the remainder of the coupler to maintain the coupler and the dye formed therefrom essentially immobile in the layer in which it is coated; and COUP is a dye forming coupler moiety.

Thus, in these structures of preferred coupler, the portion of the molecule other than the coupler moiety COUP represents a preferred Bal group in structures I. II. and III. shown above. Similarly, if COUP in these preferred structures of couplers is replaced by the D—C, D—P, or P groups from structures I. II. or III., the resulting structures would represent preferred compounds of that type. Further details of these ballast groups are shown below and in Buchanan et al. U.S. Pat. No. 5,019,492 issued May 28, 1991. In the Buchanan et al. patent such groups are shown as blocking photographically useful groups (PUGs). The disclosure of Buchanan et al. is incorporated herein by reference.

The coupler moiety represented by COUP can be a cyan dye-forming coupler such as a phenol or naphthol, a yellow dye forming coupler such as an acylacetanilide or a magenta dye forming coupler such as a pyrazolone, an imidazole, an indazolone or, preferably, a pyrazoloazole.

Preferred pyrazoloazoles include
1H-pyrazolo[2,3-c]-s-triazoles,
1H-pyrazolo[2,3-b]-1,2,4-triazoles;
1H-pyrazolo[5,1-c]-1,2,4-triazoles
1H-imidazo[1,2-b]pyrazoles and
1H-pyrazolo[1,5-d]tetrazoles.

Such couplers are described in the following patents, the disclosures of which are incorporated by reference: U.S. Pat. Nos. 3,725,067 and 4,882,266, British Patents 1,252,418 and 1,334,515, and European Published Patent application 119,741.

Particularly preferred couplers can be represented by the formulas

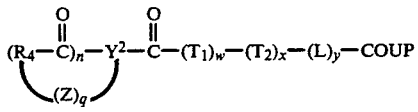

VII.

and

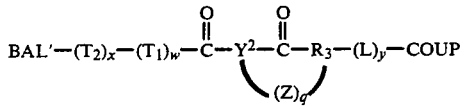

VIII.

wherein $R_3$ is unsubstituted or substituted alkylene, unsubstituted or substituted arylene, or the atoms that together with Z and $Y^2$ complete a ring, particularly an alicyclic or heterocyclic ring;

$R_4$ is a hydrogen atom, an unsubstituted or substituted alkyl, unsubstituted or substituted aryl, or the atoms that together with Z and $Y^2$ complete a ring, particularly an alicyclic or heterocyclic ring;

Z represents the atoms necessary to complete a ring with $R_3$ or $R_4$ and $Y^2$;

$Y^2$ is a substituted or unsubstituted carbon or nitrogen atom that, when n=1, provides a distance between the carbonyl groups that enables a nucleophilic displacement reaction to occur.

y, n, q, x and w are 0 and 1; when n=0, q=0;

$T_1$ and $T_2$ are releasable timing groups.

L, BAL', and COUP are as described above.

Highly preferred couplers are represented by the formulas

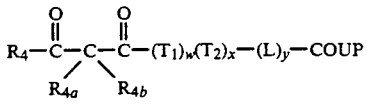

IX.

-continued

X.

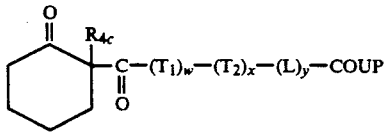

XI.

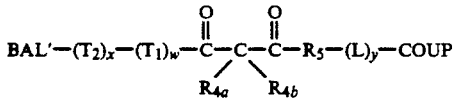

and

XII.

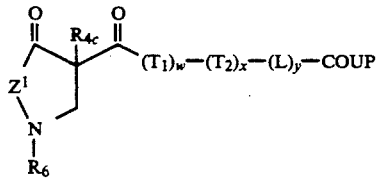

wherein:

$R_4$, $R_{4a}$, $R_{4b}$, and $R_{4c}$ individually are unsubstituted or substituted alkyl or unsubstituted or substituted aryl;

$R_5$ is unsubstituted or substituted alkylene or unsubstituted or substituted arylene;

$R_6$ is hydrogen, $COR_7$, $CO_2R_7$, $SO_2R_7$, $P(O)(OR_7)_2$, unsubstituted or substituted alkyl or aryl or a substituent that does not affect the photographic performance of the compound;

$R_7$ is hydrogen, unsubstituted or substituted alkyl, unsubstituted or substituted aryl, or $NR_8R_9$;

$R_8$ and $R_9$ individually are hydrogen, unsubstituted or substituted alkyl, or unsubstituted or substituted aryl;

$Z^1$ represents the atoms to complete a 5-, 6- or 7-membered heterocyclic ring or fused ring system;

COUP, L, $T_1$, $T_2$ and BAL' are as previously defined;

w, x, and y are independently 0 or 1.

As indicated in the preferred structures shown, the coupler and image dye derived from it can optionally contain one or more timing groups, T, between the image dye and the cleavable group or between the ballast and the cleavable group as described. The reaction of the image dye with a dinucleophile reagent can sequentially release the cleavable group from the timing group and then the timing group release the image dye or the ballast as described. The term "timing group" herein also includes a linking group that involves little or no observable delay in the releasable action. Any timing group that is known in the photographic art is useful as the timing group. Examples of useful timing groups are described in, for example, U.S. Pat. Nos. 4,248,962 and 4,409,323 and European Patent Application 255,085.

The particular timing groups employed, including the linkage by which they are attached to COUP or BAL and the cleavable group and the nature of the substitutents on the timing group can be varied to help control such parameters as rate and time of bond cleavage of the cleavable group and the COUP or BAL as well, ease of synthesis of the complete coupler, and the location of the hydrophobic substituents necessary to insure the coupler is properly ballasted.

If the coupler is joined to the cleavable group only through the timing group, then the cleavage of the bond between the timing group and the cleavable group releases the timing group and the coupler derived dye as a unit. The particular timing group in this case can control the rate at which the dye will be retained in the photographic element. In most cases, a faster rate of release from the timing group is preferred over a slower release rate. The timing group should not contain a structure that inhibits the reaction of the cleavable group with a dinucleophile reagent.

In the formula as described timing groups $T_1$ and $T_2$ are independently selected to provide, e.g., the desired rate and time of release of the coupler derived dye upon retouching. The timing groups $T_1$ and $T_2$ can be the same or different. Examples of preferred timing groups for $T_1$ and $T_2$ are as follows:

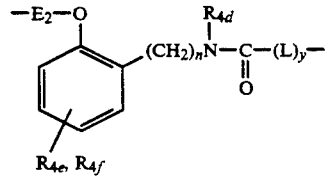

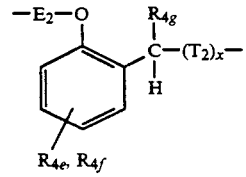

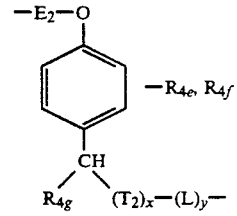

wherein:

E, and L are as defined above;

$R_{4d}$, $R_{4e}$, $R_{4f}$, and $R_{4g}$ are hydrogen or substituents, including but not limited to alkyl, aryl, nitro, chloro, acetamido, sulfonamido, sulfamoyl, carbamoyl, or carboalkoxy; and n is 0 or 1.

Other examples of useful timing groups are described in, for example, U.S. Pat. No. 4,248,962 and U.S. Pat. No. 4,772,537.

In the cleavable group as described, the two electrophilic groups, $E_1$ and $E_2$, can be any electrophilic group that enables a nucleophilic displacement reaction to occur upon reaction of the blocking group with dinucleophile reagent. While carbonyl groups are highly preferred as the electrophilic groups, other examples of useful electrophilic groups are as follows:

imido 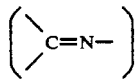 sulfonimido 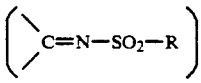

sulfo 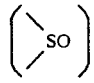 sulfonyl 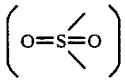

-continued thio-carbonyl 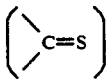

alkenyl 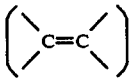

phos-phonyl 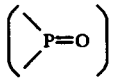

sulfenyl 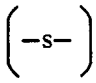

vinylogous carbonyl 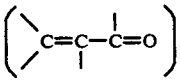

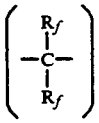

wherein $R_f$ is a substituent that causes the attached carbon atom to be an electrophilic center.

Highly preferred cleavable groups containing Z, $Y^2$, and $R_3$ are as follows:

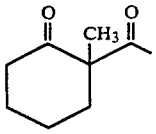

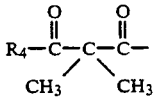

wherein $R_4$ is as described,

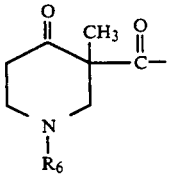

wherein $R_6$ is as described.

Dye images are formed with such couplers by reaction between the coupler and oxidized silver halide developing agents. Suitable developing agents comprise p-aminophenols and p-phenylene diamines such as are described in the Research Disclosures publication referred to infra.

The dye image so formed can be modified in hue, density, or both by application of a retouching composition. The retouching composition comprises an aqueous solution of a dinucleophile and a water-soluble organic co-solvent. The dinucleophile serves to effect cleavage of the ballast group while the organic solvent serves to solubilize the reaction products of cleavage and facilitate dye removal from the element.

Suitable dinucleophiles include compounds represented by the formula:

$$HNu^1—X^1—Nu^2H$$

wherein:

$Nu^1$ and $Nu^2$ are individually nucleophilic N, O, S, P, Se, substituted nitrogen atoms or substituted carbon atoms;

$X^1$ is a chain of j atoms wherein j is 0, 1 or 2.

Illustrative examples of suitable dinucleophiles are:

| j = 0 | j = 1 | j = 2 |
|---|---|---|
| $H_2O_2$ | $NH_2CONH_2$ | $NH_2CH_2CH_2NH_2$ |
| $NH_2NH_2$ | 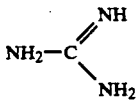 | $NH_2CH_2CO_2H$ |
| $CH_3NHNHCH_3$ | 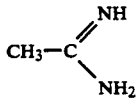 | $NH_2C(CH_3)_2CH_2OH$ |
| $NH_2OH$ | | $NH_2CH_2CH_2SH$ |
| $CH_3NHOH$ | | 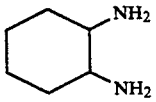 |
| $CH_3\overset{O}{\overset{\|\|}{C}}—NHOH$ | | |
| $CH_3SO_2NHNH_2$ | | |
| EtNHOH | | |
| $(CH_3)_2NOH$ | | |
| $PhNHNH_2$ | | |
| $NH_2NHCH_2CH_2OH$ | | |

Preferred dinucleophile reagents are hydroxylamine, hydrogen peroxide, and monosubstituted hydroxylamine. The dinucleophile reagent herein also includes a salt form of the reagent, such as the acid salts, for example, sulfate or bisulfite salts.

Suitable water soluble organic co-solvents are soluble in water in an amount of 5% by weight or greater and include acetonitrile, tetrahydrofuran, 1,3-dioxane, 1,4-dioxane, 1,3-dioxolane, dimethoxyethane, diglyme, triglyme, ethanol, methanol, n-propanol, i-propanol ethyleneglycol, glycerol, diethyleneglycol, 1-methyl-2-pyrroldinone, sulfolane, dimethylsulfoxide, triethylamine, morpholine, N-methylmorpholine, N,N'-dimethylpropyleneurea. Preferred are methanol, ethanol and acetonitrile.

The retouching composition preferably is basic and most preferrably is at a pH in the range of 9.0 to 12.5; the pH value being that which would be read if an equal volume of water were substituted for the organic solvent.

The organic solvent is typically employed in admixture with water in proportions ranging from 1 to 9, to 9 to 1 parts by volume. The dinucleophile is employed in a concentration ranging from 0.01 molar up to the solubility limits in the particular solvent system with which it is employed.

In a preferred embodiment, the dinucleophile concentration is between about 0.5 and 3.0 molar and the organic solvent comprises between 45 and 70 parts by volume of the solvent system.

The retouching composition can be employed by local application to the desired region of the photographic element or by dipping the element in a bath of the composition for a time sufficient to reduce the density of the dye to the desired level. Details of useful procedures are described in the articles from Professional Photographer referred to above. In some cases it may be advantageous to treat the element first with the retouching solution and then remove the cleaved dye by washing with a separate solution of an acidic or basic solution of one or more of the cosolvents.

Novel couplers of this invention can be prepared by conventional synthetic techniques such as those described in the patents referred to supra, and illustrated in the synthetic example infra.

Examples of couplers useful in this invention are show in Table 1, which follows:

TABLE 1

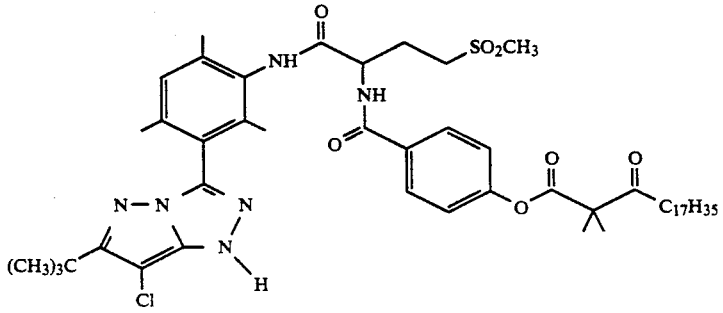

Coupler 1

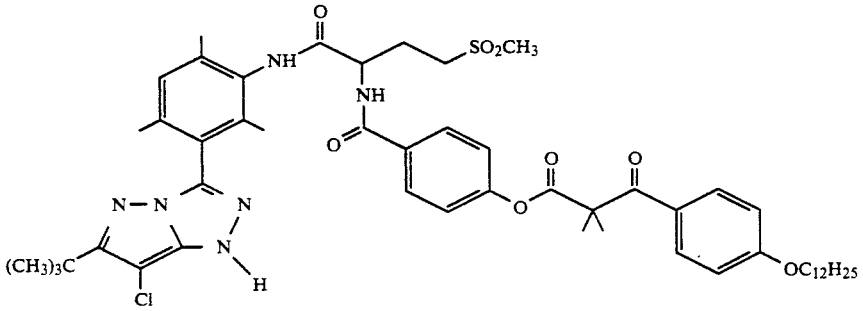

Coupler 2

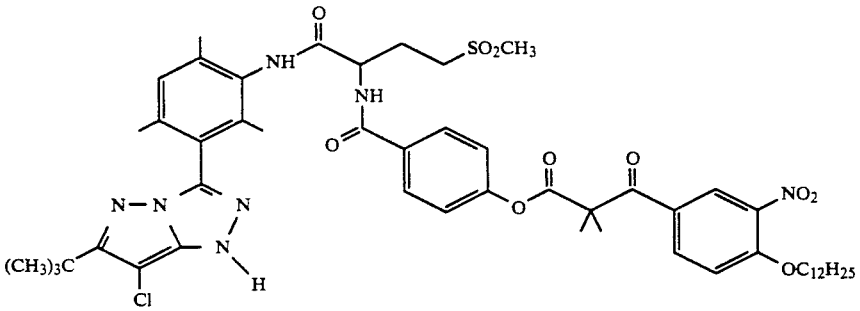

Coupler 3

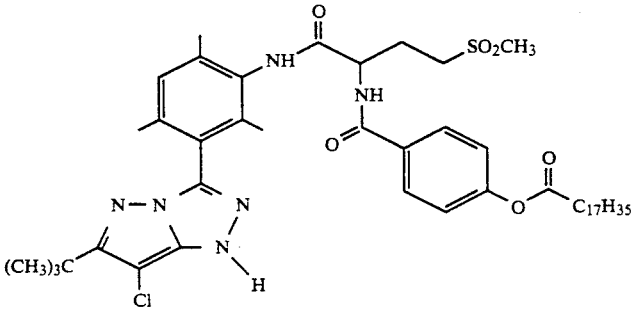

Coupler 4

TABLE 1-continued
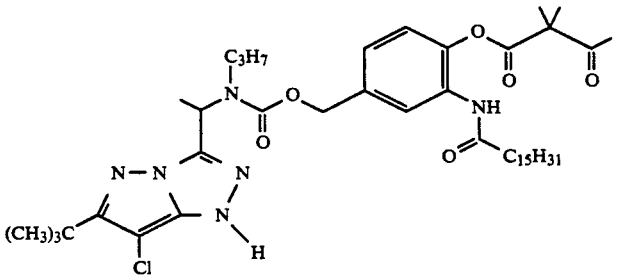
Coupler 5
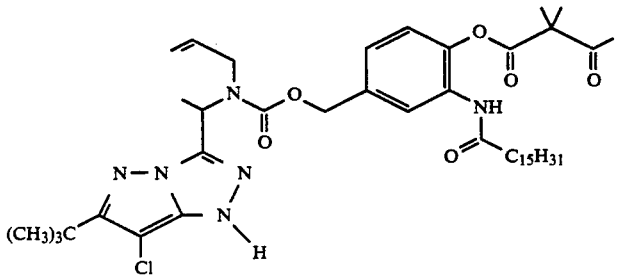
Coupler 6
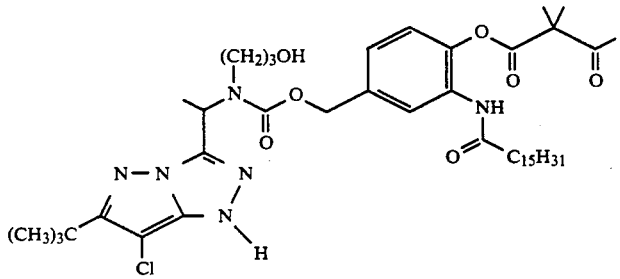
Coupler 7
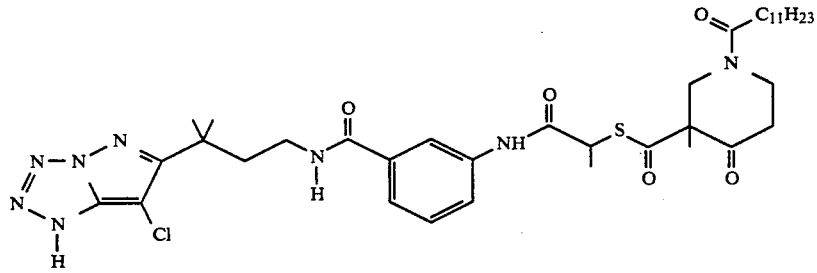
Coupler 8
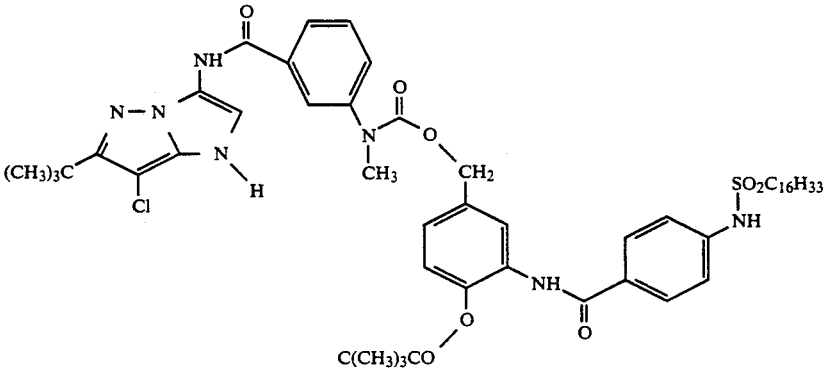
Coupler 9

TABLE 1-continued
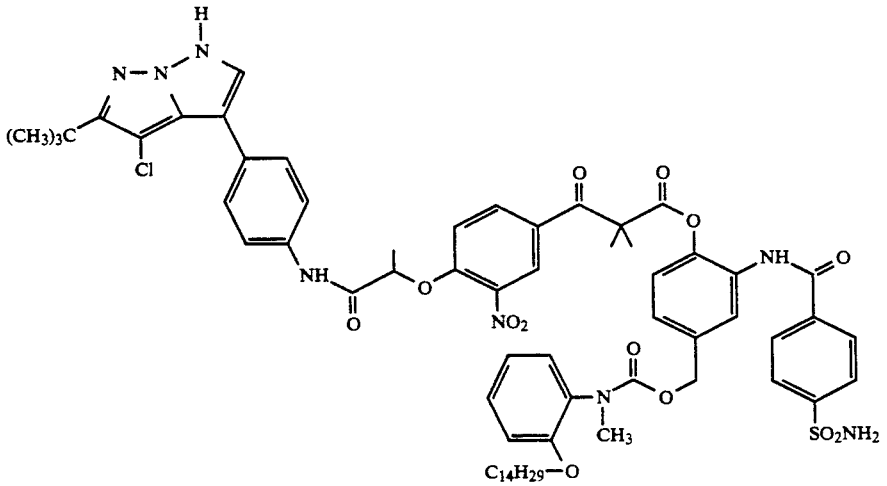
Coupler 10
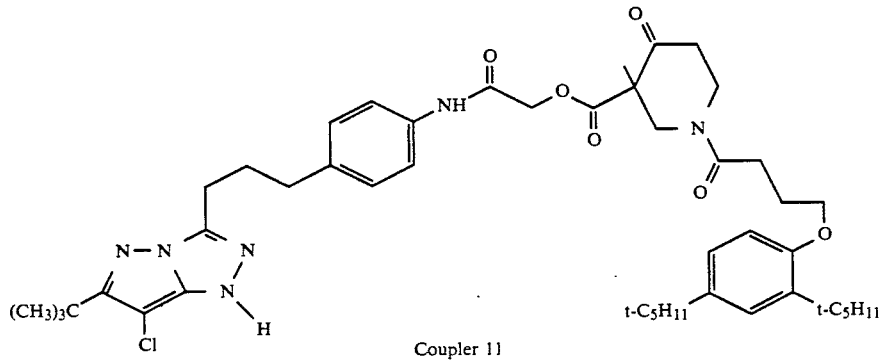
Coupler 11
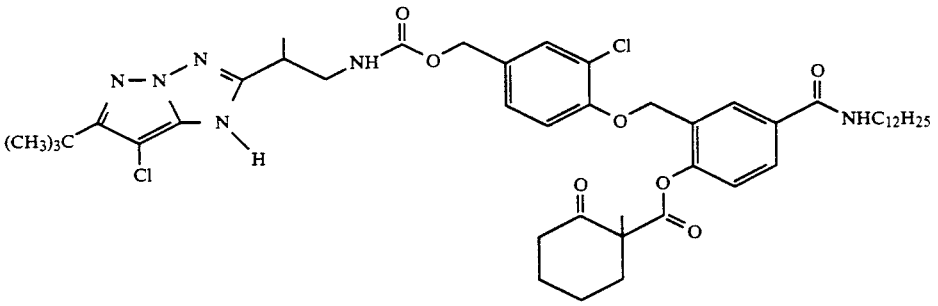
Coupler 12
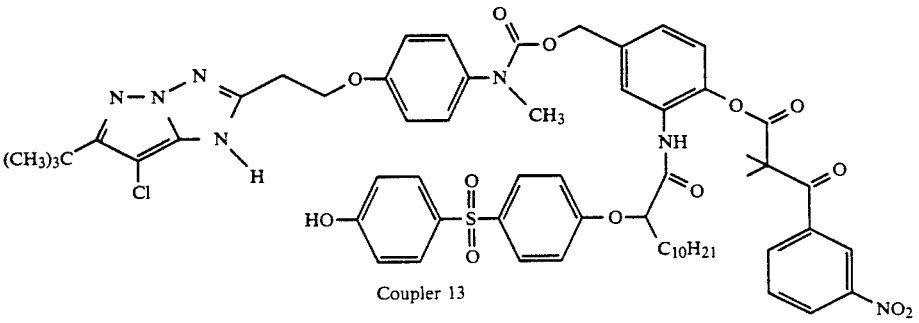
Coupler 13

TABLE 1-continued
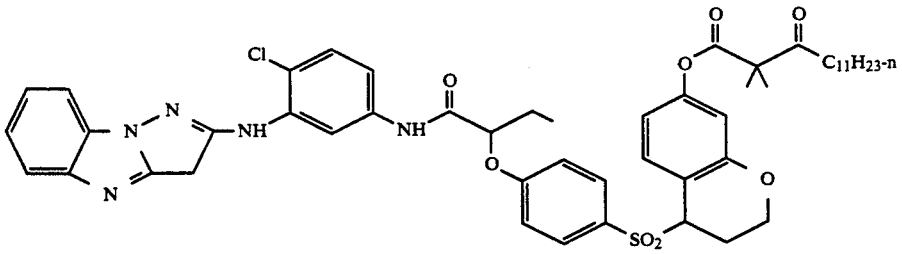
Coupler 14
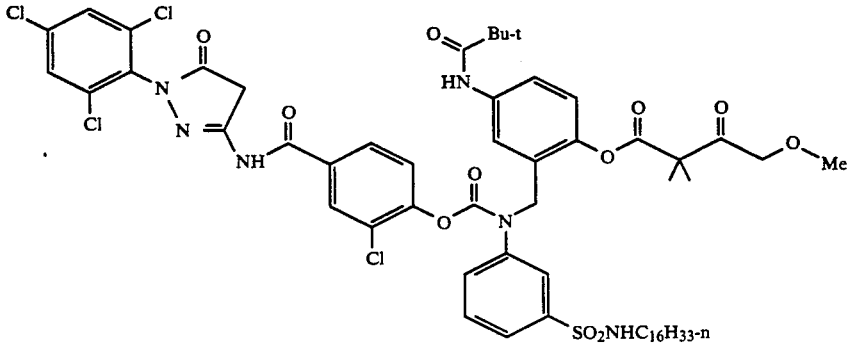
Coupler 15
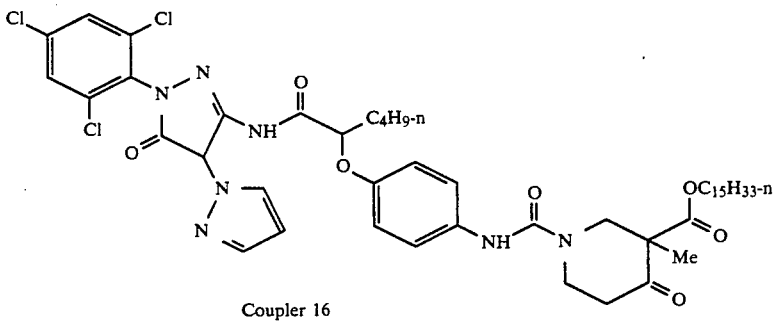
Coupler 16
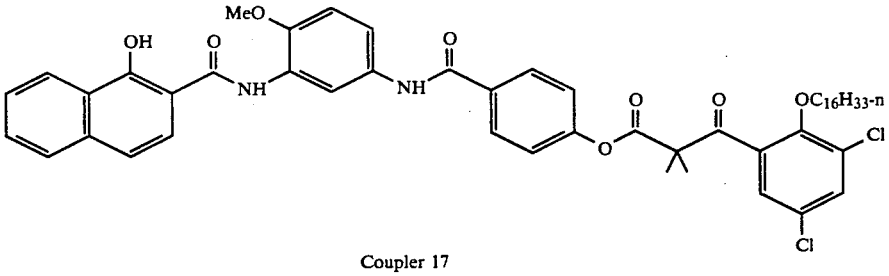
Coupler 17
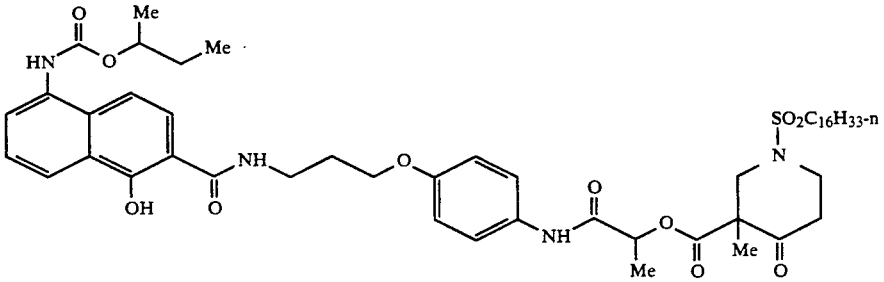
Coupler 18

TABLE 1-continued
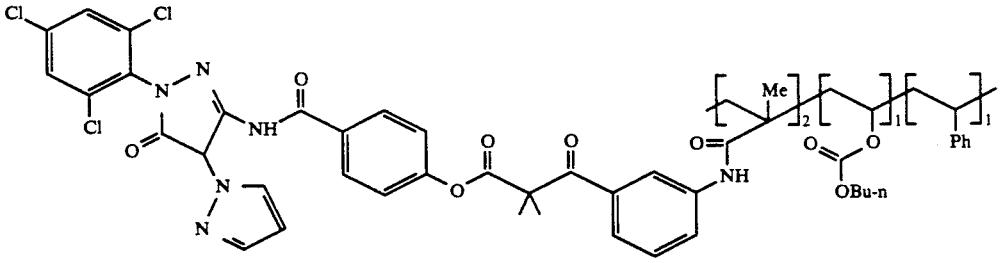
Coupler 19
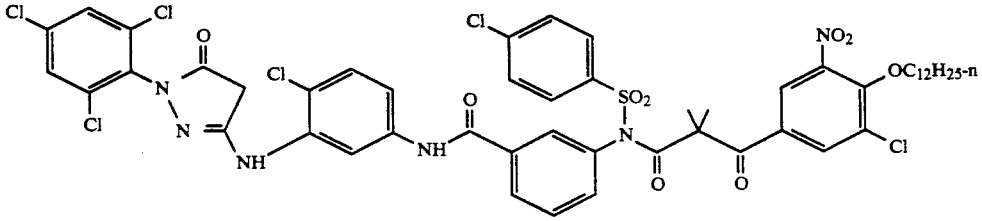
Coupler 20
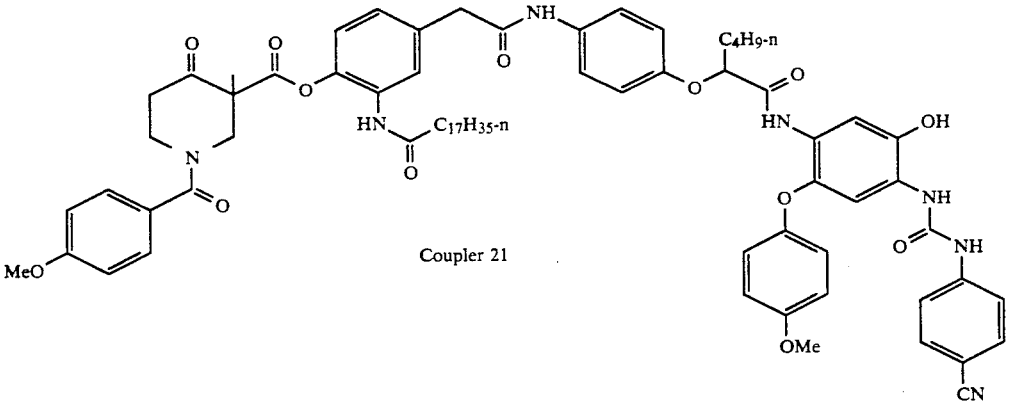
Coupler 21
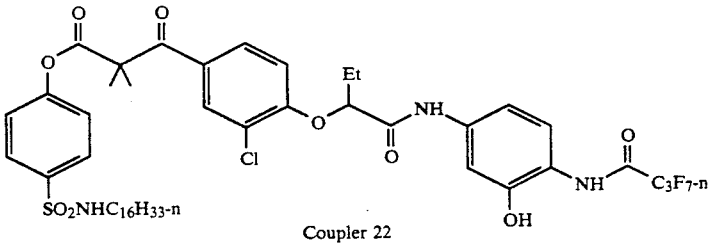
Coupler 22
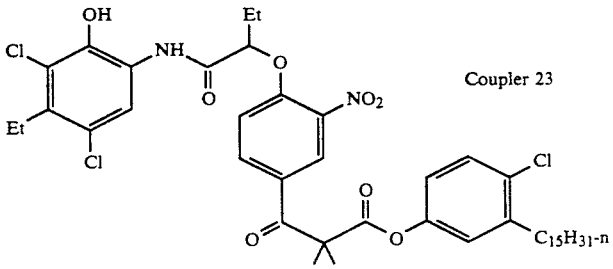
Coupler 23

TABLE 1-continued

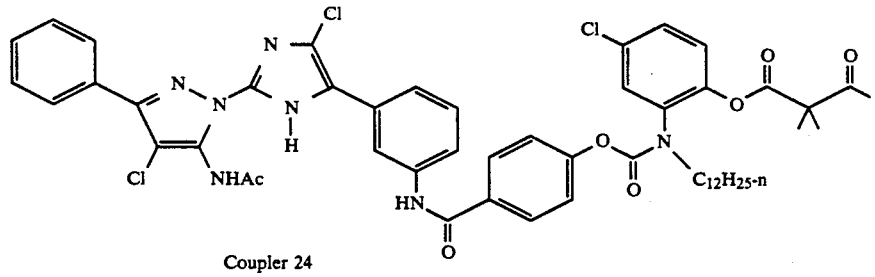

Coupler 24

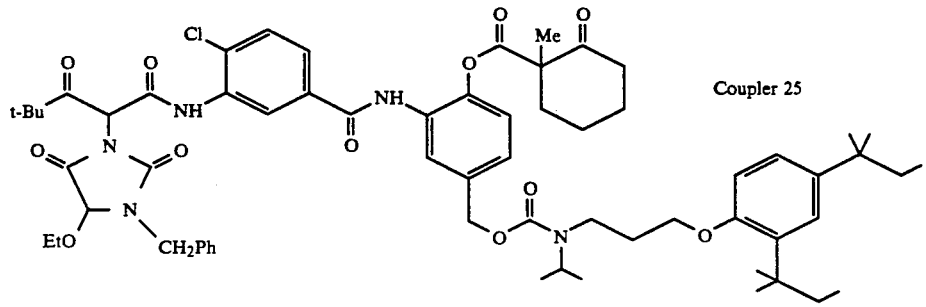

Coupler 25

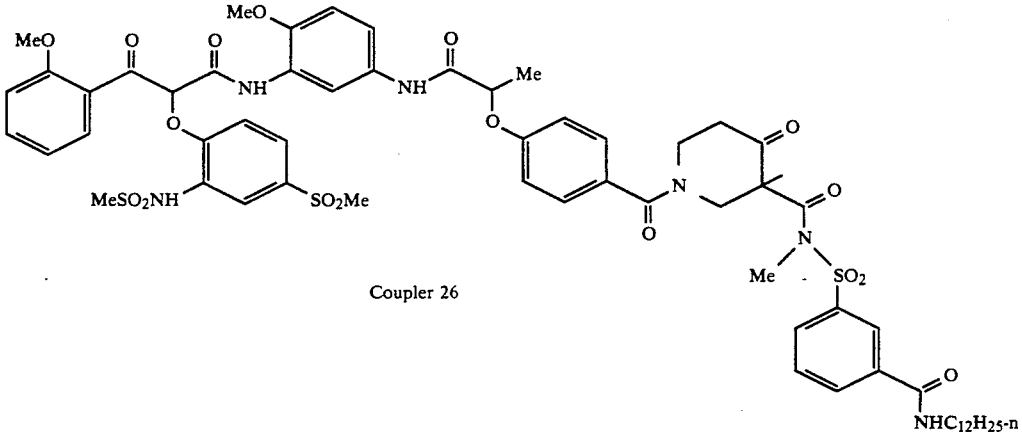

Coupler 26

The photographic elements can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982.

In the following discussion of suitable materials for use in the emulsions and elements of this invention, reference will be made to *Research Disclosure*, December 1989, Item 308119, published by Kenneth Mason Publications, Ltd., Dudley Annex, 12*a* North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers generally described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (See Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section IX), plasticizers and lubricants (See Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

The coupler compounds can be used and incorporated in photographic elements in the way that such compounds have been used in the past. Incorporation by use of a coupler solvent, as shown in the working examples, is a preferred technique.

The photographic elements of this invention can be exposed to actinic radiation, typically in the visible region of the spectrum, to form a latent image, as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

Couplers of the invention can be prepared by reactions and methods known in the organic synthesis art. A typical synthesis is illustrated by the following example.

Synthesis of Coupler #1

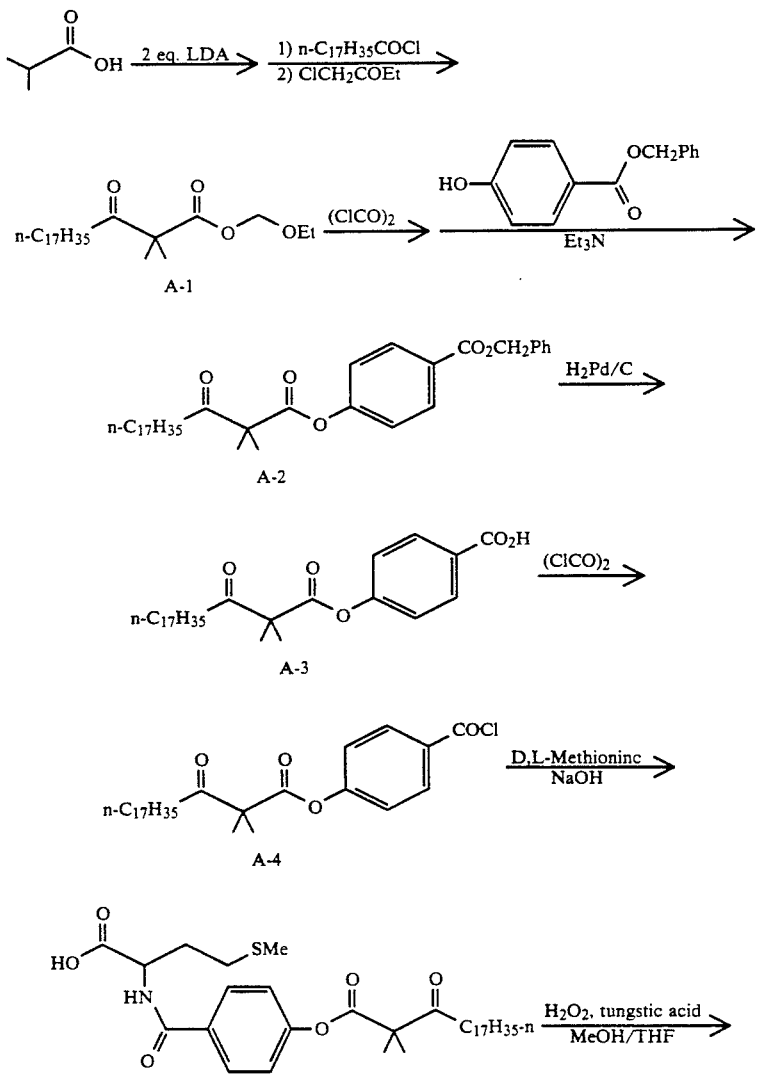

-continued

Synthesis of Coupler #1

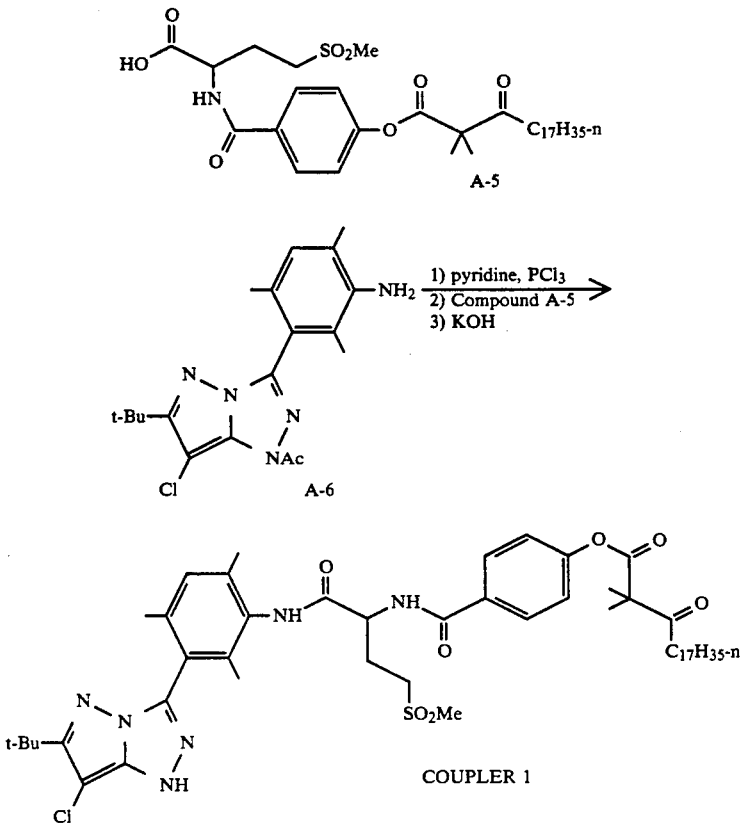

Preparation of Compound A-1

Isobutyric acid (15.5 g 176 mmol) was added to a −20° C. solution of lithium diisopropylamide (353 mmol) in THF (800 mL) over ten minutes, and the mixture was allowed to warm to ambient temperature. After 3 h, all the volatiles were removed in vacuo with gentle heating (<50° C.) to provide a yellow powder. The powder was redissolved in THF, and the solution was cooled to −78° C. Stearoyl chloride (53.4 g, 176 mmol) in THF (34 mL) was added rapidly, and the mixture was permitted to warm to ambient temperature. After stirring overnight, the mixture was cooled to −20° C., treated with chloromethyl ethyl ether (24.8 g, 262 mmol), and permitted to warm to ambient temperature. After 3.5 h the mixture was diluted with ether (1L), washed with saturated $NaHCO_3$ (2×250 mL), 5% $NaHCO_3$ (150 mL), brine (150 mL), dried ($MgSO_4$), and concentrated in vacuo to afford an oil. Chromatography on silica gel, (major band) using 3:2 heptane/dichloromethane eluent provided compound A-1 (27.5 g).

Preparation of Compound A-2

A dichloromethane solution (35 mL) of compound A-1 (22.1 g, 54 mmol), chilled in an ice bath, was treated with oxalyl chloride (20.4 g, 161 mmol), 90% DMF (aq.) (0.10 mL), and then removed from the ice bath and permitted to warm to ambient temperature. After 5.5 h all volatiles were removed in vacuo with gentle heating (<40° C.)

The acid chloride was redissolved in dichloromethane (70 mL), cooled in ice, treated with triethylamine (10.9 g, 108 mmol) and benzyl p-hydroxybenzoate (12.3 g, 54.0 mmol), and permitted to warm to ambient temperature. After stirring overnight the reaction mixture was diluted with ethyl acetate (1L), washed with 1N HCl (1×100, 1×50 mL), water (50 mL), brine (50 mL), dried ($MgSO_4$), and concentrated in vacuo. Chromatography on silica gel (major band), using 4–20% ethyl acetate/heptane eluent provided compound A-2 (23.4 g) as a white solid.

Preparation of Compound A-3

Hydrogenolysis of the benzyl ester of A-2 (22.6 g, 40.0 mmol) was effected in ethyl acetate (215 mL), using 10% Pd/C as catalyst (2.27 g), in a Parr hydrogenator at ca. 50 PSI of hydrogen, overnight. The catalyst was removed by filtration and the filtrate was concentrated in vacuo to provide compound A-3 (18.5 g) as a white solid.

Preparation of Coupler #1

A solution of acid A-3 (4.79 g, 10.1 mmol) in THF (20 mL) was treated with oxalyl chloride (2.56 g, 20.2 mmol) and DMF (0.10 mL). After stirring for 1 h, the volatiles were removed in vacuo to provide compound A-4 as a brown solid. This was used in the subsequent reaction.

The ballast acid A-5 was prepared in two steps from acid chloride A-4 using the method described in U.S. Pat. No. 5,021,325. Reaction of A-5 with 1-acetyl-6-t-butyl-7-chloro-(3-amino-2,4,6-trimethyl-1-phenyl)-1H-pyrazolo-[3,2-c]-1,2,4-triazole (compound A-6) and subsequent deacetylation also uses the method described in U.S. Pat. No. 5,021,325. Chromatography on silica gel, (major band) using 50% ethyl acetate/dichloromethane eluent provided coupler 1 as a tan glass. Analysis for $C_{51}H_{75}ClN_6O_7S$ (calc., found): C (64.36, 64.08); H (7.94, 7.80); N(8.83, 8.77). The following examples further illustrate this invention.

EXAMPLE 1 (INVENTION)

To demonstrate the practice of the invention, coupler #3 shown in Table 1 above was incorporated into a photographic element as follows: A green sensitive silver bromoiodide gelatine emulsion was mixed with a coupler dispersion comprising coupler #3 dispersed in half its weight of a mixture of tritolyl phosphates. The resulting mixture was coated onto a cellulose triacetate support according to the following format:

| | | |
|---|---|---|
| OVERCOAT LAYER: | gelatine | 7.5 g/m$^2$ |
| | bis(vinylsulfonylmethyl)ether hardener (1.9% of total gelatine weight) | |
| EMULSION LAYER: | AgBrI emulsion | .73 g/m$^2$ (as silver) |
| | Coupler #3 | 1.94 mmoles/m$^2$ |
| | Gelatine | 3.2 g/m$^2$ |
| FILM SUPPORT: | | |

The resulting photographic element was imagewise exposed to light through a graduated density test object in a commercial sensitometer (3000K light source, 0-3 step wedge, with a Wratten 99 plus 0.6ND filter) to provide a developable latent image. The film was then developed using the E6 process described in *The British Journal of Photography Annual,* 1977, pages 194–7, with the final stabilizing bath omitted, to yield an image in magenta dye having a Status A green maximum density of 2.44.

A retouching solution according to the invention was prepared by mixing 7.7 g of 30 percent by weight hydrogen peroxide solution with 20 cc of a carbonate buffer having an ionic strength of 0.375 and a pH of 10. To this mixture was added 50 cc of 3 A alcohol and the resulting mixture was diluted with distilled water to a total volume of 100 cc. A 1 cm square of the maximum density area of the processed element was suspended in the retouching solution subjected to gentle stirring. After 5 minutes the film was removed, rinsed with tap water and dried. The Status A green density of the film so treated was read and found to have been reduced to 0.99. This illustrates that the retouching solution was effective to reduce the dye density of the magenta dye formed from coupler #3.

EXAMPLE 2 (COMPARISON)

A photographic element was prepared and treated as in Example 1 except that comparison coupler X-1 (structure shown below) not having a cleavable ballast was employed. The sample had a Status A green density of 4.32 after treating with the retouching solution for 5 minutes compared to a density of 4.43 before treatment. This illustrates that the dye formed from this coupler is substantially unaffected by the retouching solution.

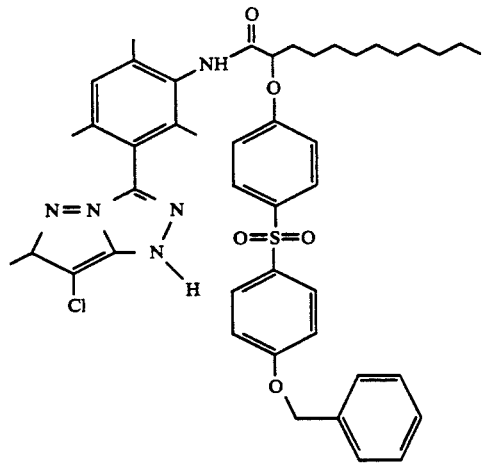

Comparison Coupler X-1

EXAMPLE 3 (COMPARISON)

The photographic element prepared in Example 1 was treated with a retouching solution prepared as in Example 1 except that hydrogen peroxide, the dinucleophile, was omitted. After treating with this retouching solution the photographic film had a Status A green density of 2.29 after 5 minutes. This illustrates that without a dinucleophile the retouching solution is of limited effectiveness.

EXAMPLE 4 (INVENTION)

A photographic element was prepared and treated as in Example 1, except that coupler #4 from Table 1 was employed in place of coupler #3. The sample had a Status A green maximum density of 2.65 prior to treatment with the retouching solution, and a density of 1.25 after a 5-minute treatment.

EXAMPLE 5 (COMPARISON)

A photographic element was prepared and treated as in Example 4 except that the hydrogen peroxide was omitted from the retouching solution. After a 5-minute treatment the Status A green maximum density was 2.01. This illustrates the importance of the dinucleophile hydrogen peroxide in retouching dyes derived from couplers having simple ester cleaving groups.

EXAMPLE 6 (INVENTION)

A photographic element was prepared, exposed and developed as in Example 1 to yield a film sample having a Status A green maximum density of 2.48. A solution was prepared by dissolving 19.2 g of hydroxylamine hydrochloride in approximately 50 cc of distilled water and the solution pH adjusted to 8.05 by adding 50% sodium hydroxide dropwise, and the resulting solution volume adjusted to 100 cc with distilled water. A retouching solution was prepared by mixing 48 cc of the above solution with 50 cc of a carbonate buffer having an ionic strength of 0.515 and a pH of 10, 100 cc of 3 A alcohol, and adjusting the total volume to 200 cc. A 1 cm square sample from the maximum density area of the film was suspended in this solution while gently stirring. After 5 minutes the sample was removed, rinsed with tap water, and allowed to dry. The Status A green density of the treated sample was 0.79. This illustrates the effectiveness of alternate dinucleophiles.

EXAMPLE 7

Photographic elements were prepared, exposed, and developed as in example 1 except that the couplers from Table 1, above, as shown in Table 2, below, were in each case substituted for coupler #3. Samples from the maximum density area of each film were treated with retouching solution as in Example 1 and, after rinsing and drying the Status A green density were read. The results showing the extent of dye bleaching are tabulated in Table 1.

TABLE 2

| COUPLER # | Density Before Retouching | Density After Retouching |
|---|---|---|
| #1 | 2.44 | 1.21 |
| #2 | 3.60 | 3.50 |
| #6 | 3.48 | 1.92 |

When the time that the element containing Coupler #2 and was extended from 5 minutes to 13 minutes, the Status A density obtained was 2.51.

EXAMPLE 8

A multilayer film was prepared as follows:

On a cellulose triacetate support provided with a subbing layer was coated each layer having the composition set forth below to prepare a multilayer color photographic light-sensitive material.

In the composition of the layers, the coating amounts are shown as g/m$^2$ except for sensitizing dyes, which are shown as the molar amount per mole of silver halide present in the same layer.

| | |
|---|---|
| **First layer: Antihalation Layer** | |
| Black Colloidal Silver | 0.43 (as silver) |
| Gelatin | 2.44 |
| **Second layer: Intermediate Layer** | |
| Gelatin | 1.22 |
| **Third layer: Slow Red Sensitive Layer** | |
| Silver iodobromide Emulsion | 0.36 (as silver) |
| Red sensitizing dyes | $1.42 \times 10^{-3}$ |
| Cyan coupler C-1 | 0.54 |
| Solvent-2 | 0.27 |
| Gelatin | 0.86 |
| **Fourth Layer: Fast Red Sensitive Layer** | |
| Silver iodobromide emulsion | 0.65 (as silver) |
| Red sensitizing dyes | $1.05 \times 10^{-3}$ |
| Cyan coupler C-1 | 0.97 |
| Solvent-2 | 0.49 |
| Gelatin | 1.51 |
| **Fifth Layer: Intermediate Layer** | |
| Dye-1 | 0.06 |
| Gelatin | 0.61 |
| **Sixth Layer: Slow Green Sensitive Layer** | |
| Silver iodobromide emulsion | 0.32 (as silver) |
| Green sensitizing dyes | $2.0 \times 10^{-3}$ |
| Coupler #1 | 0.50 |
| Solvent-1 | 0.25 |
| Gelatin | 0.86 |
| **Seventh Layer: Fast Green Sensitive Layer** | |
| Silver iodobomide emulsion | 0.54 (as silver) |
| Green sensitizing dyes | $1.0 \times 10^{-3}$ |
| Coupler #1 | 0.97 |
| Solvent-1 | 0.49 |
| Gelatin | 1.51 |
| **Eighth Layer: Yellow Filter Layer** | |
| Dye-2 | 0.27 |
| Gelatin | 0.61 |
| **Ninth Layer: Slow Blue Sensitive Layer** | |
| Silver iodobromide emulsion | 0.22 (as silver) |
| Blue Sensitizing dye | $1.08 \times 10^{-3}$ |
| Coupler Y-1 | 0.70 |
| Solvent-2 | 0.23 |
| Gelatin | 1.08 |
| **Tenth Layer: Fast Blue Sensitive Layer** | |
| Silver iodobromide emulsion | 0.54 (as silver) |
| Blue sensitizing dye | $1.60 \times 10^{-3}$ |
| Coupler Y-1 | 1.56 |
| Solvent-2 | 0.52 |
| Gelatin | 2.37 |
| **Eleventh Layer: First Protective Layer** | |
| Ultraviolet Absorbing Dyes | 0.51 |
| Gelatin | 1.40 |
| **Twelfth Layer: Second Protective Layer** | |
| Fine grain silver bromide emulsion | 0.12 (as silver) |
| Matte | 0.02 |
| Bis(vinylsulfonylmethane) | 0.26 |
| Gelatin | 0.97 |
| Solvent-1 | tritolyl phosphates |
| Solvent-2 | dibutylphthalate |

The resulting photographic element was exposed through a step wedge to actinic radiation and processed in the E-6 process. A retouching solution was prepared by mixing 23.1 g of a 30 percent by weight solution of hydrogen peroxide, 20 cc of a carbonate buffer having an ionic strength of 0.375 and a pH of 10, 50 cc of 3 A alcohol, and diluting with water to make a volume of 100 cc. A 1 cm sample of the maximum density area of the multilayer color film was suspended in this retouching solution for 7 minutes while gently stirring. After rinsing and drying the Status A density was read. Table 3 lists the red, green, and blue densities of the sample before and after treatment with the retouching solution. It can be seen that the treatment removes 53 percent of the green density while the red and blue densities are reduced by only 10–12 percent. This demonstrates the very desirable feature of selectivity (i.e., bleaching one image dye without significantly affecting the other image dyes) of the invention.

TABLE 3

| Status A Density | Red | Green | Blue |
|---|---|---|---|
| Before Retouching | 2.93 | 3.65 | 3.14 |
| After Retouching | 2.64 | 1.92 | 2.76 |
| Percent Change | −10 | −53 | −12 |

The compounds used in the above film element, which are not described elsewhere in this specification, are as follows:

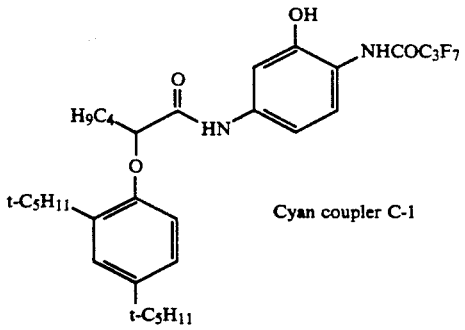

Cyan coupler C-1

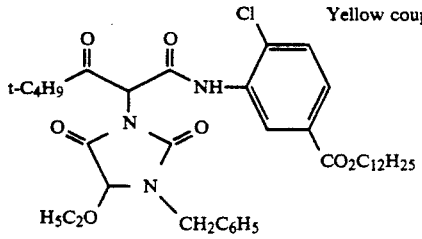

Yellow coupler Y-1

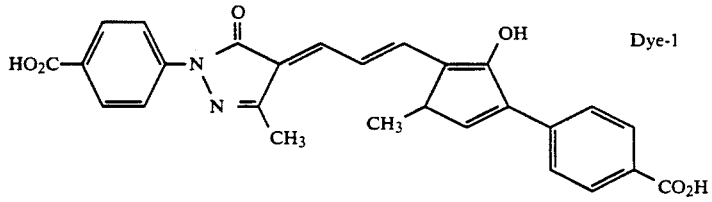

Dye-1

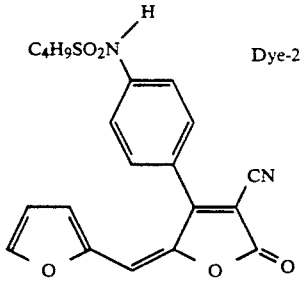

Dye-2

This invention has been described in detail with particular reference to preferred embodiments thereof. It will be understood that variations and modifications can be made within the spirit and scope of the invention.

What is claimed is:

1. A method of retouching a dye image formed in a photographic element by a dye having the structure:

D—C—Bal I where:

D is the residue of oxidized silver halide color developing agent,

C is the residue of a dye forming coupler,

Bal is a ballast group which immobilizes the dye in the photographic element and which is cleavable from the remainder of the dye by reaction with a dinucleophile to thereby render the dye mobile, the method comprising:

a) applying to the dye image an aqueous basic solution of a dinucleophile and a water-soluble organic co-solvent to cleave the ballast group and solubilize the dye, and b) removing solubilized dye from the photographic element.

2. A method of claim 1 wherein C is the residue of a magenta dye forming coupler.

3. A method of claim 2 wherein the magenta dye forming coupler is a pyrazoloazole.

4. A method of claim 1 wherein the dinucleophile has the structure:

$HNu^1—X^1—Nu^2H$ wherein:

$Nu^1$ and $Nu^2$ are nucleophilic groups, and $X^1$ is a chain of j atoms, where j is an integer of 0, 1 or 2.

5. A method of claim 4, where the dinucleophile is selected from the group consisting of hydrogen peroxide, hydroxylamine, monosubstituted hydroxylamines, and salts of these compounds.

6. A method of claim 1 wherein the water soluble organic co-solvent is selected from the group consisting of methanol, ethanol and acetonitrile.

* * * * *